US007962971B1

(12) United States Patent
Spence

(10) Patent No.: US 7,962,971 B1
(45) Date of Patent: Jun. 21, 2011

(54) FLIP CAP SYSTEM

(76) Inventor: Roy Ronald Spence, Brooklyn, NY (US)

( * ) Notice: Subject to any disclaimer, the term of this patent is extended or adjusted under 35 U.S.C. 154(b) by 489 days.

(21) Appl. No.: 12/151,906

(22) Filed: May 9, 2008

Related U.S. Application Data

(63) Continuation-in-part of application No. 11/521,230, filed on Oct. 16, 2006, now abandoned.

(51) Int. Cl.
*A42B 1/00* (2006.01)

(52) U.S. Cl. ..... 2/209.11; 2/171.1; 2/171.7; 2/209.3

(58) Field of Classification Search ..... 2/171.6, 2/171.7, 171.8, 182.1, 184.5, 209.11, 209.12, 2/209.3, 171.1, 171.4, 181
See application file for complete search history.

(56) References Cited

U.S. PATENT DOCUMENTS 2,349,471 A * 5/1944 Starbeck ..... 2/171.5
5,181,277 A * 1/1993 Sherman ..... 2/181.4
5,685,017 A 11/1997 Kraft
6,202,219 B1 * 3/2001 Cheever ..... 2/195.2
6,240,566 B1 * 6/2001 Scantlin ..... 2/171
6,718,557 B2 * 4/2004 Claro ..... 2/195.2
7,203,971 B2 * 4/2007 Claro ..... 2/195.2

* cited by examiner

*Primary Examiner* — Katherine Moran
*Assistant Examiner* — Sally C Cline

(57) ABSTRACT

A headband is positionable in a generally horizontal orientation. The headband has a front left panel and a front right panel. Each of the front panels has a lower edge stitched to the headband at a forward extent. Each of the front panels has a forward edge stitched together over a central extent above a central region of the headband. Each of the front panels has a vertically extending rearward edge. The headband has a left rear panel and a right rear panel. Each of the rear panels has a forward edge stitched to a rearward edge of a front panel. Each of the rear panels has a free rear edge and free lower edge. The lower and rear edges of the rear panels are adapted to be positioned rearwardly in a first orientation and forwardly in a second orientation.

4 Claims, 5 Drawing Sheets

FLIP CAP SYSTEM

RELATED APPLICATION

The present application is a continuation-in-part of U.S. patent application Ser. No. 11/521,230 filed Oct. 16, 2006 now abandoned, the subject matter of which is incorporated herein by reference.

BACKGROUND OF THE INVENTION

1. Field of the Invention

The present invention relates to a flip cap system and more particularly pertains to reconfiguring a cap between a primary orientation with the majority of a wearer's head covered and an alternate orientation with a rearward extent of a wearer's head exposed as selectively desired by a wearer.

2. Description of the Prior Art

The use of head covering of known designs and configurations is known in the prior art. More specifically, head covering of known designs and configurations previously devised and utilized for the purpose of covering the head of a wearer through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,685,017 issued Nov. 11, 1997 to Kraft relates to a Modular Hat.

While these devices fulfill their respective, particular objectives and requirements, the aforementioned patent does not describe a flip cap system that allows for reconfiguring a cap between a primary orientation with the majority of a wearer's head covered and an alternate orientation with a rearward extent of a wearer's head exposed as selectively desired by a wearer.

In this respect, the flip cap system according to the present invention substantially departs from the conventional concepts and designs of the prior art, and in doing so provides an apparatus primarily developed for the purpose of reconfiguring a cap between a primary orientation with the majority of a wearer's head covered and an alternate orientation with a rearward extent of a wearer's head exposed as selectively desired by a wearer.

Therefore, it can be appreciated that there exists a continuing need for a new and improved flip cap system which can be used for reconfiguring a cap between a primary orientation with the majority of a wearer's head covered and an alternate orientation with a rearward extent of a wearer's head exposed as selectively desired by a wearer. In this regard, the present invention substantially fulfills this need.

SUMMARY OF THE INVENTION

In view of the foregoing disadvantages inherent in the known types of head covering of known designs and configurations now present in the prior art, the present invention provides an improved flip cap system. As such, the general purpose of the present invention, which will be described subsequently in greater detail, is to provide a new and improved flip cap system and method which has all the advantages of the prior art and none of the disadvantages.

To attain this, the present invention essentially comprises a flip cap system. First provided is a headband. The headband is positionable in a generally horizontal orientation. In this manner the head of a wearer is encompassed. The headband has an interior surface. The headband has an exterior surface. The headband has free ends. The free ends are positionable adjacent to a rearward region of a wearer's head. The free ends extend forwardly. In this manner a forward region of a wearer's head is encompassed. The headband has an adjustment strap. The adjustment strap has a fixed end. The fixed end of the adjustment strap is secured to one of the free ends of the headband. The adjustment strap has a remote end. The remote end has a female snap. The female strap faces inwardly. The adjustment strap has a central section. The central region has a slider. In this manner the length of the adjustment strap may be adjusted. Further in this manner the size of the headband and hat may be adjusted to fit wearers with different size heads.

A generally triangular front left panel is provided. A similarly configured generally triangular front right panel is provided. Each of the front panels has a lower edge. The lower edge is stitched to the headband at a forward extent. Each of the front panels has a forward edge. The forward edge is stitched together over a central extent above a central region of the headband. Each of the front panels has a vertically extending rearward edge.

Provided next is a pair of rear panels. The rear panels include a generally triangular left rear panel. The rear panels include a similarly configured generally triangular right rear panel. Each of the rear panels has a forward edge. The front edge is stitched to a rearward edge of a front panel. Each of the rear panels has a free rear edge. Each of the rear panels has a free lower edge. Each of the rear panels has cutouts. The cutouts are provided from the rear and lower edges above the rearward region of the headband. The lower and rear edges of the rear panels are adapted to be positioned rearwardly in a first orientation. In this first orientation the majority of the rearward extent of a wearer's head is covered. The lower and rear edges of the rear panels are adapted to be positioned forwardly in a second orientation. In the second orientation the majority of the rearward extent of a wearer's head is uncovered.

Further provided are supplemental securement components. The supplemental securement components include inwardly facing female snaps. The female snaps are provided on the interior surface of each rear panel adjacent to a rear edge. The supplemental securement components include complementary outwardly facing male fasteners. The male fasteners are provided on the headband adjacent to the adjustment strap. The female snaps and male fasteners are adapted to secure the rear panels rearwardly in the primary orientation. The supplemental securement components also include outwardly facing female snaps. The female snaps are provided on the exterior surface of each rear panel adjacent to a rear edge. The supplemental securement components include complementary outwardly facing male fasteners. The male fasteners are provided on the front panels. The female snaps are male fasteners are adapted to secure the rear panels forwardly in the secondary orientation.

Provided last is a forwardly extending bill. The bill is secured to the headband adjacent to a forward region of a wearer's head. In this manner eye shade is provided to a wearer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved flip cap system which has all of the advantages of the prior art head covering of known designs and configurations and none of the disadvantages.

It is another object of the present invention to provide a new and improved flip cap system which may be easily and efficiently manufactured and marketed.

It is further object of the present invention to provide a new and improved flip cap system which is of durable and reliable constructions.

An even further object of the present invention is to provide a new and improved flip cap system which is susceptible of a low cost of manufacture with regard to both materials and labor, and which accordingly is then susceptible of low prices of sale to the consuming public, thereby making such flip cap system economically available to the buying public.

Even still another object of the present invention is to provide a flip cap system for reconfiguring a cap between a primary orientation with the majority of a wearer's head covered and an alternate orientation with a rearward extent of a wearer's head exposed as selectively desired by a wearer.

Lastly, it is an object of the present invention to provide a new and improved flip cap system. A headband is positionable in a generally horizontal orientation. The headband has a front left panel and a front right panel. Each of the front panels has a lower edge stitched to the headband at a forward extent. Each of the front panels has a forward edge stitched together over a central extent above a central region of the headband. Each of the front panels has a vertically extending rearward edge. The headband has a left rear panel and a right rear panel. Each of the rear panels has a forward edge stitched to a rearward edge of a front panel. Each of the rear panels has a free rear edge and free lower edge. The lower and rear edges of the rear panels are adapted to be positioned rearwardly in a first orientation and forwardly in a second orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
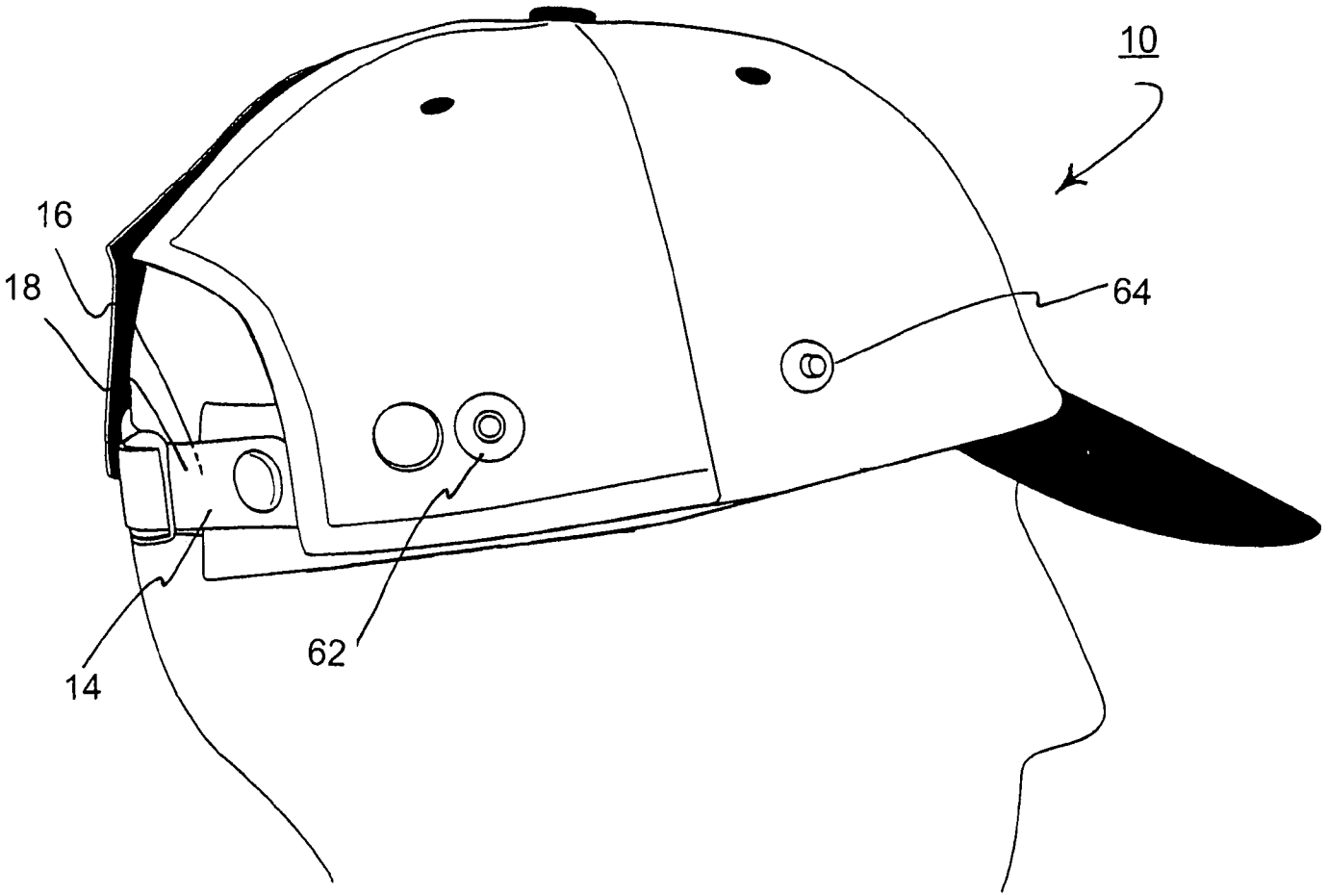
FIG. 1 is a side view of a flip cap system constructed in accordance with the principles of the present invention.
Figure 2:
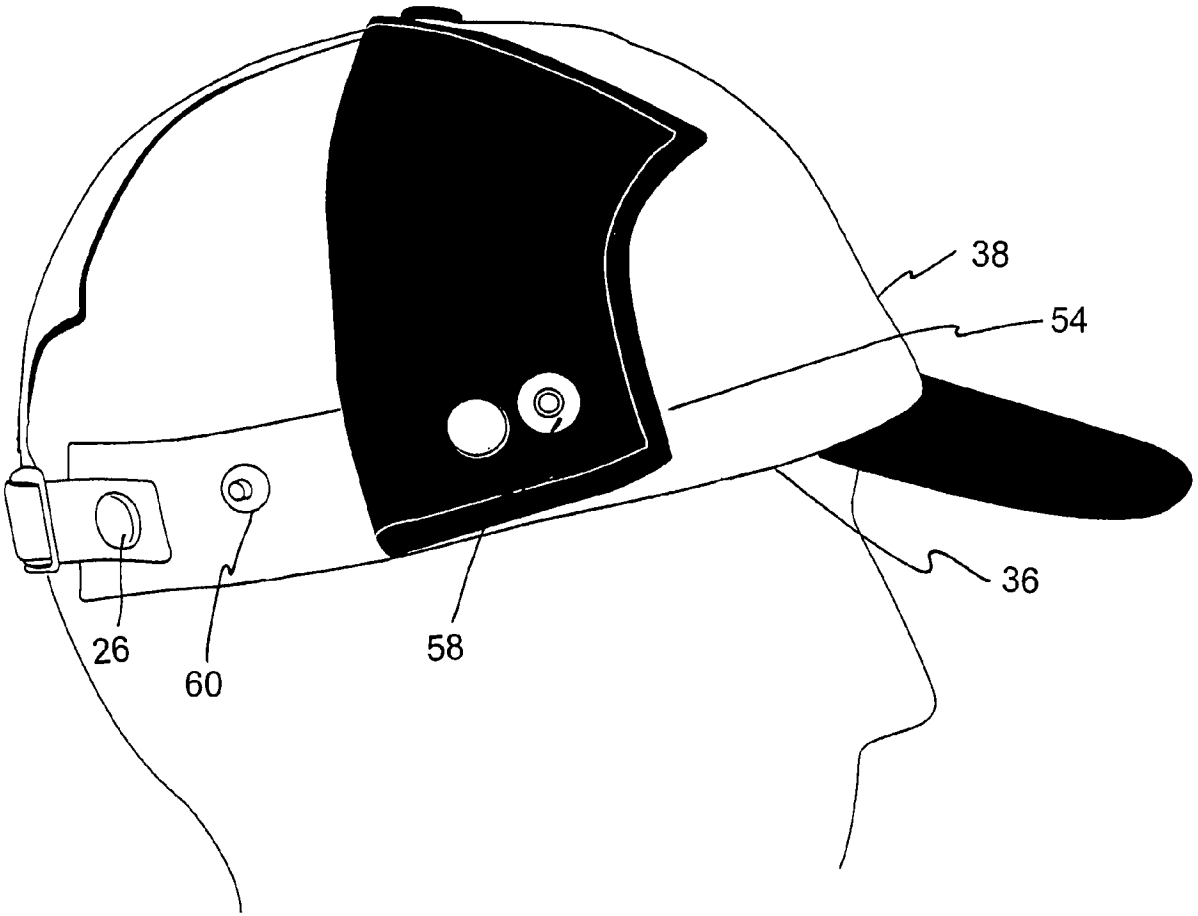
FIG. 2 is a side view of the flip cap system show in FIG. 1 but with the panel in an alternate forward orientation.
Figure 3:
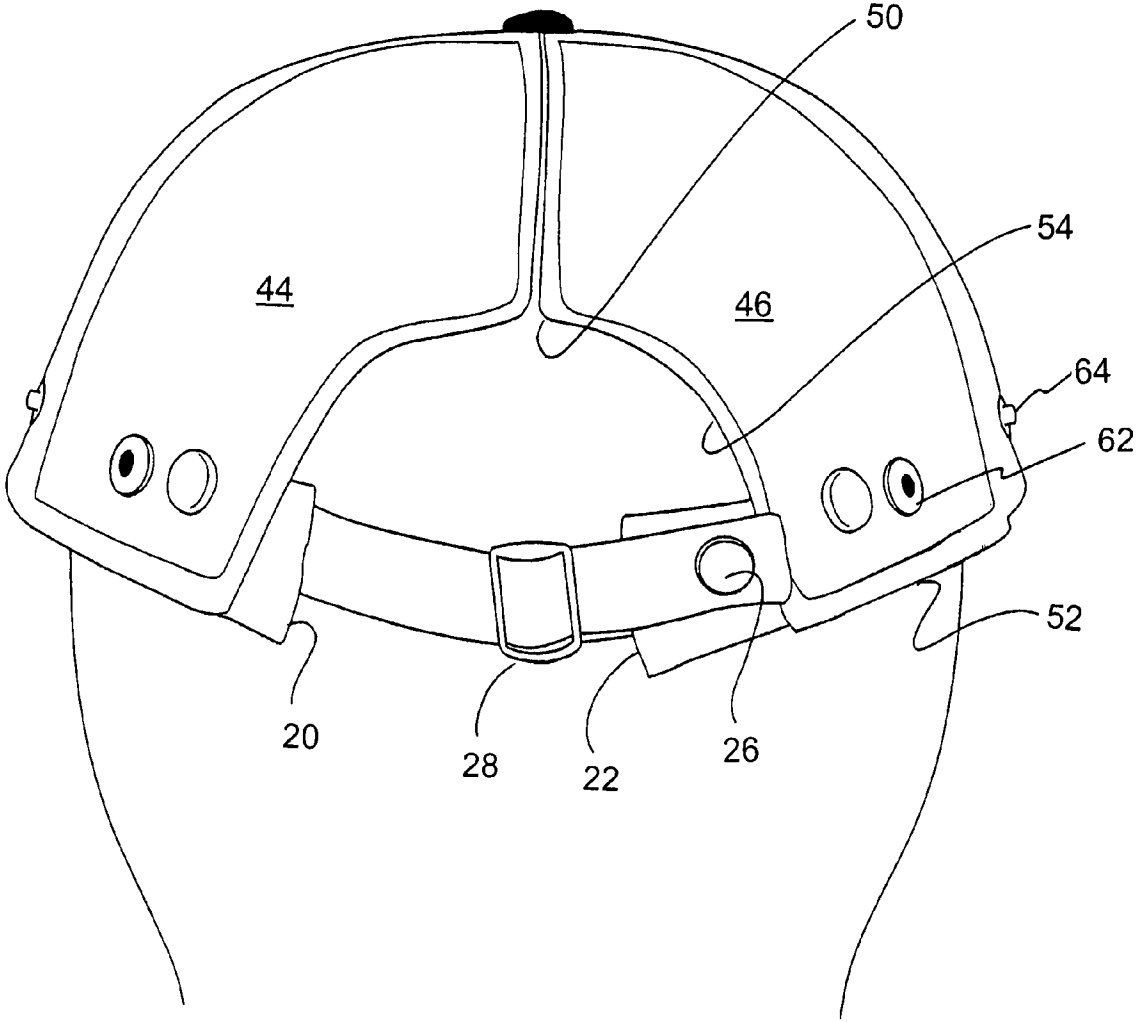
FIG. 3 is a rear view of the flip cap system shown in FIG. 1.
Figure 4:
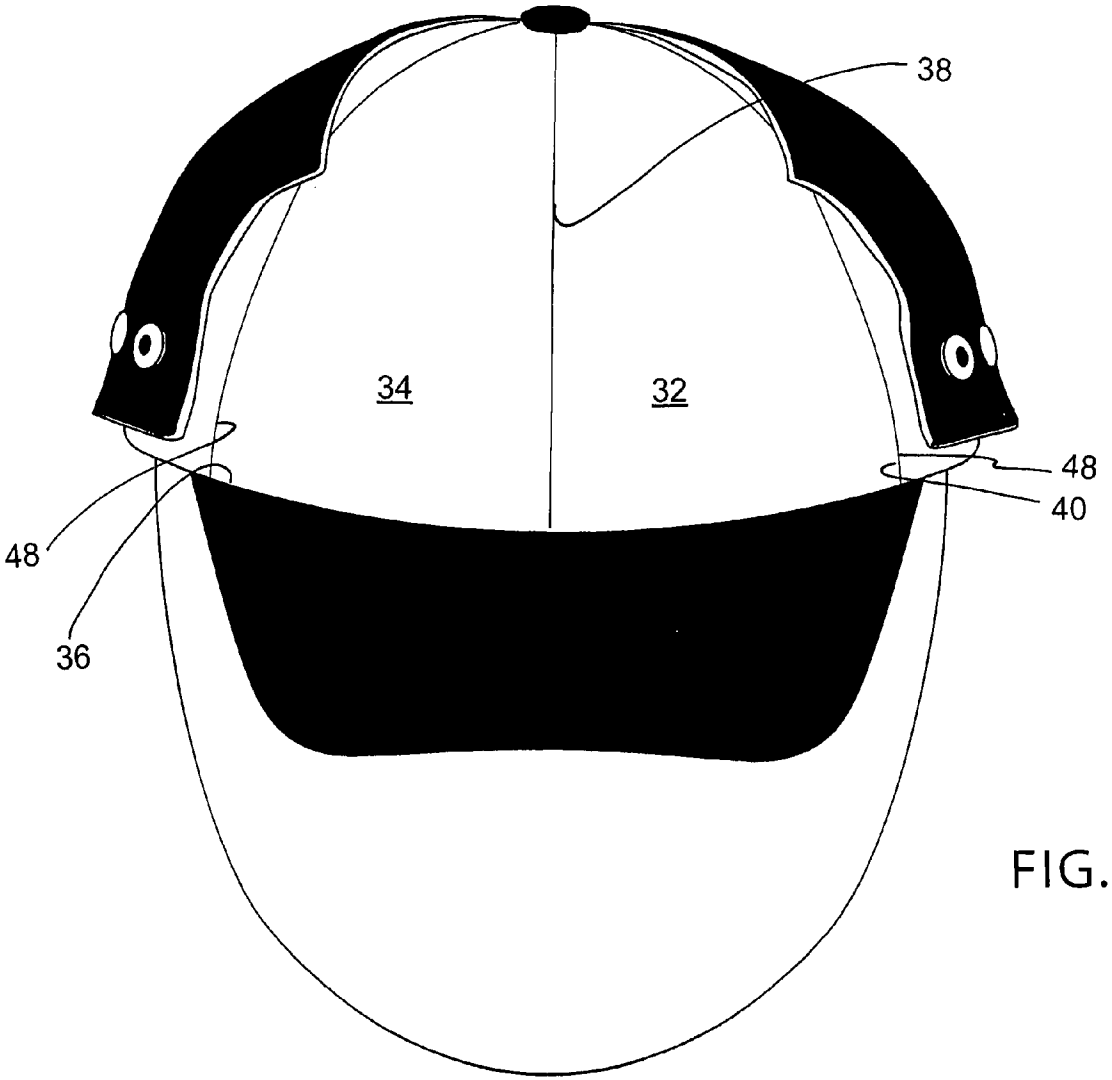
FIG. 4 is a front view of the flip cap system as shown in FIG. 2.
Figure 5:
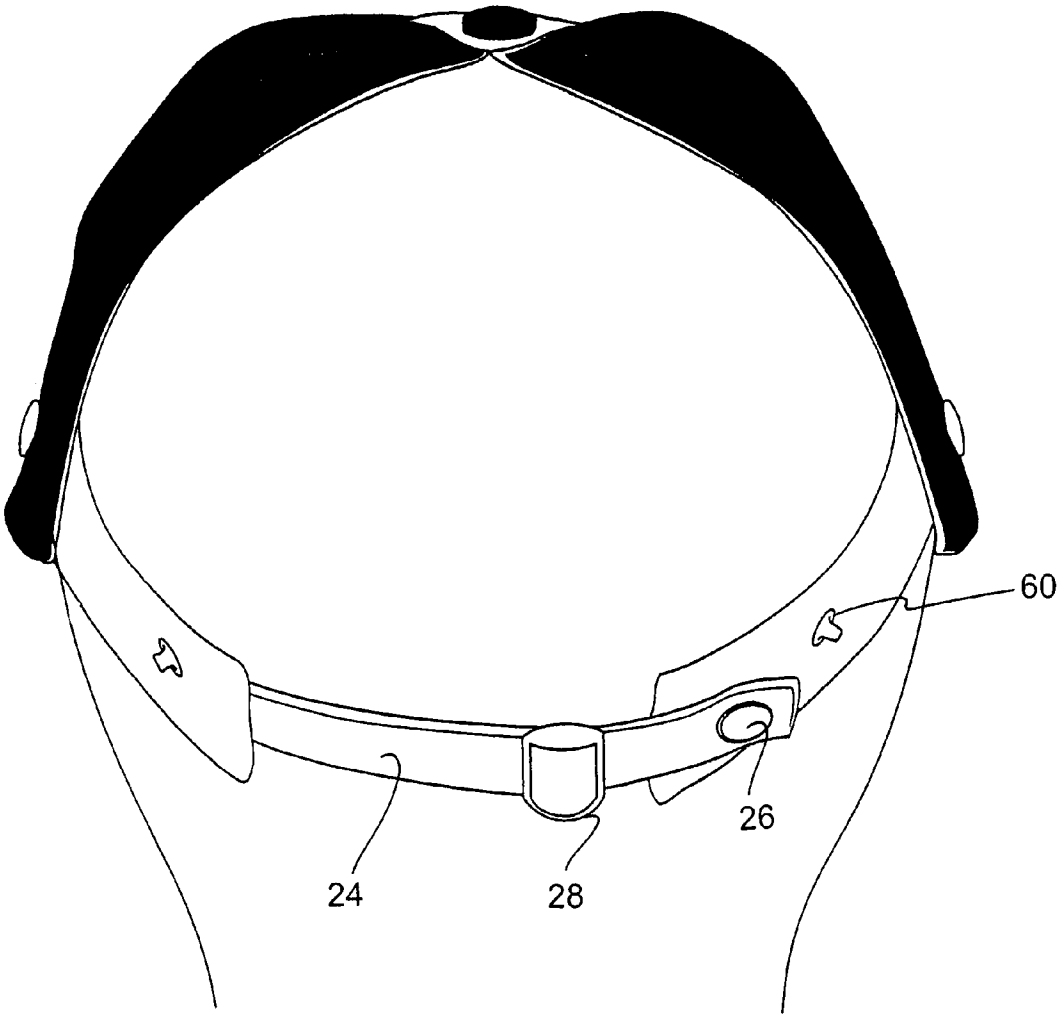
FIG. 5 is a rear view of the flip cap system as shown in FIGS. 2 and 4.

With reference now to the drawings, and in particular to FIG. 1 thereof, the preferred embodiment of the new and improved flip cap system embodying the principles and concepts of the present invention and generally designated by the reference numeral 10 will be described.

The present invention, the flip cap system 10 is comprised of a plurality of components. Such components in their broadest context include a headband, a front left panel, a front right panel and a pair of rear panels. Such components are individually configured and correlated with respect to each other so as to attain the desired objective.

First provided is a headband 14. The headband is positionable in a generally horizontal orientation. In this manner the head of a wearer is encompassed. The headband has an interior surface 16. The headband has an exterior surface 18. The headband has free ends 20, 22. The free ends are positionable adjacent to a rearward region of a wearer's head. The free ends extend forwardly. In this manner a forward region of a wearer's head is encompassed. The headband has an adjustment strap 24. The adjustment strap has a fixed end. The fixed end of the adjustment strap is secured to one of the free ends of the headband. The adjustment strap has a remote end. The remote end has a female snap 26. The female strap faces inwardly. The adjustment strap has a central section. The central region has a slider 28. In this manner the length of the adjustment strap may be adjusted. Further in this manner the size of the headband and hat may be adjusted to fit wearers with different size heads.

A generally triangular front left panel 32 is provided. A similarly configured generally triangular front right panel 34 is provided. Each of the front panels has a lower edge 36. The lower edge is stitched to the headband at a forward extent. Each of the front panels has a forward edge 38. The forward edge is stitched together over a central extent above a central region of the headband. Each of the front panels has a vertically extending rearward edge 40.

Provided next is a pair of rear panels. The rear panels include a generally triangular left rear panel 44. The rear panels include a similarly configured generally triangular right rear panel 46. Each of the rear panels has a forward edge 48. The front edge is stitched to a rearward edge of a front panel. Each of the rear panels has a free rear edge 50. Each of the rear panels has a free lower edge 52. Each of the rear panels has cutouts 54. The cutouts are provided from the rear and lower edges above the rearward region of the headband. The lower and rear edges of the rear panels are adapted to be positioned rearwardly in a first orientation. In this first orientation the majority of the rearward extent of a wearer's head is covered. The lower and rear edges of the rear panels are adapted to be positioned forwardly in a second orientation. In the second orientation the majority of the rearward extent of a wearer's head is uncovered.

Further provided are supplemental securement components. The supplemental securement components include inwardly facing female snaps 58. The female snaps are provided on the interior surface of each rear panel adjacent to a rear edge. The supplemental securement components include complementary outwardly facing male fasteners 60. The male fasteners are provided on the headband adjacent to the adjustment strap. The female snaps and male fasteners are adapted to secure the rear panels rearwardly in the primary orientation. The supplemental securement components also include outwardly facing female snaps 62. The female snaps are provided on the exterior surface of each rear panel adjacent to a rear edge. The supplemental securement components include complementary outwardly facing male fasteners 64. The male fasteners are provided on the front panels. The female snaps are male fasteners are adapted to secure the rear panels forwardly in the secondary orientation.

Provided last is a forwardly extending bill 68. The bill is secured to the headband adjacent to a forward region of a wearer's head. In this manner eye shade is provided to a wearer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flip cap system comprising:

a headband positionable in a generally horizontal orientation;

a front left panel and a front right panel, each of the front panels having a lower edge stitched to the headband at a forward extent, each of the front panels having a forward edge stitched together over a central extent above a central region of the headband, each of the front panels having a vertically extending rearward edge;

a pair of rear panels including a left rear panel and a right rear panel, each of the rear panels having a forward edge stitched to a rearward edge of a front panel, each of the rear panels having a free rear edge and free lower edge, the lower and rear edges of the rear panels adapted to be positioned rearwardly in a first orientation and forwardly in a second orientation; and supplemental securement components including inwardly facing female snaps on an interior surface of each rear panel adjacent to a rear edge and complementary outwardly facing male fasteners on the headband adapted to secure the rear panels rearwardly in a primary orientation, the supplemental securement components also including outwardly facing female snaps on an exterior surface of each rear panel adjacent to a rear edge and complementary outwardly facing male fasteners on the front panels adapted to secure the rear panels forwardly in a secondary orientation.

2. The system as set forth in claim 1 and further including:

a forwardly extending bill secured to the headband adjacent to a forward region of a wearer's head for providing eye shade to a wearer.

3. The system as set forth in claim 1 wherein the headband has free ends and further including:

an adjustment strap with a fixed end secured to one of the free ends of the headband and a remote end with a female snap facing inwardly, the adjustment strap having a central section with a slider for adjustment of the length of the adjustment strap for adjusting the size of the headband and hat to fit wearers with different size heads.

4. A flip cap system for reconfiguring a cap between a primary orientation with the majority of a wearer's head covered and an alternate orientation with a rearward extent of a wearer's head exposed as selectively desired by a wearer comprising, in combination:

a headband positionable in a generally horizontal orientation to encompass the head of a wearer, the headband having laterally spaced free ends, the headband having an interior surface and an exterior surface, the headband free ends positionable adjacent to a rearward region of a wearer's head and extending forwardly to encompass a forward region of a wearer's head, the headband having an adjustment strap with a fixed end secured to one of the free ends of the headband and a remote end with a female snap facing inwardly, the adjustment strap having a central section with a slider for adjustment of the length of the adjustment strap for adjusting the size of the headband and hat to fit wearers with different size heads;

a generally triangular front left panel and a similarly configured generally triangular front right panel, each of the front panels having a lower edge stitched to the headband at a forward extent, each of the front panels having a forward edge stitched together over a central extent above a central region of the headband, each of the front panels having a vertically extending rearward edge;

a pair of rear panels including a generally triangular left rear panel and a similarly configured generally triangular right rear panel, each of the rear panels having a forward edge stitched to a rearward edge of a front panel, each of the rear panels having a free rear edge and free lower edge, the free rear edges of the rear panels being free of fasteners, cutouts formed in the rear panels from the rear and lower edges above the rearward region of the headband, the lower and rear edges of the rear panels adapted to be positioned rearwardly in a first orientation to cover the majority of the rearward extent of a wearer's head, the lower and rear edges of the rear panels adapted to be positioned forwardly in a second orientation to uncover the majority of the rearward extent of a wearer's head;

supplemental securement components including inwardly facing female snaps on an interior surface of each rear panel adjacent to a rear edge and complementary outwardly facing male fasteners on the headband adjacent to the adjustment strap adapted to secure the rear panels rearwardly in the primary orientation, the supplemental securement components also including outwardly facing female snaps on an exterior surface of each rear panel adjacent to a rear edge and complementary outwardly facing male fasteners on the front panels adapted to secure the rear panels forwardly in the secondary orientation; and a forwardly extending bill secured to the headband adjacent to a forward region of a wearer's head for providing eye shade to a wearer.

* * * * *